US005187049A

United States Patent [19]

Sher et al.

[11] Patent Number: 5,187,049

[45] Date of Patent: Feb. 16, 1993

[54] PHOTOSENSITIVE THERMALLY DEVELOPED COMPOSITIONS

[75] Inventors: Frank T. Sher; David R. Whitcomb, both of St. Paul, Minn.

[73] Assignee: Minnesota Mining and Manufacturing Company, St. Paul, Minn.

[21] Appl. No.: 552,887

[22] Filed: Jul. 16, 1990

[51] Int. Cl.[5] ..... G03C 1/72

[52] U.S. Cl. ..... 430/340; 430/338; 430/339; 430/341; 430/343; 430/344

[58] Field of Search ..... 430/338, 339, 341, 343, 430/344, 340

[56] References Cited

U.S. PATENT DOCUMENTS

| | | | |
|---|---|---|---|
| 3,647,433 | 3/1972 | Contois | 430/82 |
| 4,336,232 | 6/1982 | Winslow | 430/339 |
| 4,373,020 | 2/1983 | Winslow | 430/339 |
| 4,386,154 | 5/1983 | Smith et al. | 430/336 |
| 4,394,433 | 7/1983 | Gatzke | 430/151 |
| 4,460,677 | 7/1984 | Smith et al. | 430/336 |
| 4,670,374 | 6/1987 | Bellus et al. | 430/620 |

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

A photothermographic composition is disclosed comprising a sensitizing dye and the salt of an oxidizing acid and a leuco dye, wherein said acid consists of a Group V, VI, or VII element and oxygen.

20 Claims, No Drawings

PHOTOSENSITIVE THERMALLY DEVELOPED COMPOSITIONS

CROSS-REFERENCE TO RELATED CASES

This case is related to U.S. patent application Ser. No. 83,522 filed on Aug. 7, 1987, continued as U.S. Ser. No. 394,250, filed Aug. 11, 1989.

BACKGROUND OF THE INVENTION

1. Field of the Invention

This invention relates to light sensitive thermally developable (i.e., photothermographic), imageable systems, particularly those employing an oxidizer, sensitizing dye, and a leuco dye. More particularly, this invention relates to imageable systems comprised of a leuco dye oxidizing acid salt and a sensitizing dye.

2. Description of the Related Art

Many processes and compositions use leuco dyes to provide optical densities in the imaged article. For example, U.S. Pat. No. 4,017,313 uses a combination of a photosensitive leuco dye, a photosensitizer for the dye, an aromatic aldehyde and a secondary or tertiary amine. Other photosensitive systems using leuco dyes are included in U.S. Pat. Nos. 3,390,997, 2,884,326, and 2,772,284. The mechanism of these last two patents is disclosed in "Aromatic Aldehyde-Leuco Dye Photooxidation" H. D. Hartzler, Pure Appl. Chem. 1979, 49, pp. 353–356. *Light-Sensitive Systems* (J. Kosar; John Wiley and Sons: New York, 1965; p. 369), describes print-out photosensitive systems comprising a binder, leuco dye, organic halogen compound and a photosensitizing dye. Because these are printout systems, there is no thermal amplification. A great many photosensitive materials have been used in different imageable processes utilizing various photoinitiated phenomena such as photohardening of polymerizable materials (e.g., negative-acting printing plates, photosolubilizing materials (e.g., positive-acting printing plates), light initiated diazonium salt coupling reactions (e.g., diazonium microfilm), etc. A class of iodonium photoinitiators for both cationic and epoxy polymerization (e.g., U.S. Pat. Nos. 4,026,705 and 3,981,897) has also been proposed as equivalent to other photoinitiators in certain ethylenically unsaturated printing plate compositions (e.g., U.S. Pat. No. 3,741,769).

Photothermographic imageable systems are well known in the art. By definition photothermographic systems are light sensitive imageable systems which are thermally developed. Photothermographic systems typically require development temperatures in the range of 80° to 200° C. A number of imageable systems employ photosensitive compounds, leuco dyes or bleachable dyes, and nitrate salts to generate color images, imageable systems, which are sensitive to ultraviolet (UV) light, comprising a leuco dye or bleachable dye, nitrate ion, and diazonium salts in a binder are disclosed in U.S. Pat. No. 4,370,401. In those cases wherein a leuco dye system is employed, a photothermographic, negative acting imageable system is provided; that is, the optical density in the final image is more dense in areas which are light struck than in areas which are not light struck. Conversely, in those cases wherein a bleachable dye system is employed, a photothermographic, positive acting imageable system is provided, that is, the optical density in the final image is more dense in areas which are not light struck than in areas which are light struck.

Related imageable compositions comprising a diazonium salt and leuco dye in a binder is disclosed in U.S. Pat. No. 4,394,433. These unamplified compositions are positive-acting photothermographic compositions, and differ fundamentally from the compositions of the present invention, which are amplified by the action of an oxidizing anion.

Additional light sensitive, thermally developable imageable systems are known. U.S. Pat. No. 4,460,677 describes a thermally developable imageable system comprising a leuco dye, nitrate ion, and a spectrally sensitized organic compound having photolyzable halogen atoms. Similarly, U.S. Pat. No. 4,386,154 describes a thermally developable imageable system comprising a leuco dye, a nitrate ion, and a spectrally sensitized compound selected from (1) aromatic iodonium salts and (2) compounds containing photolyzable halogen atoms. Both of these compositions act as a negative image forming systems in that, upon heat development, the greatest image density is formed in the light struck areas.

Light sensitive, thermally developable imageable systems are also described in several Japanese Patents. For example, Japanese Pat. No. 77,025,330 pertains to a UV light sensitive two component positive acting imageable composition comprised of an oxazine or phenothiazine leuco dye (BLMB) mono or disubstituted with a dialkylamino group, and an oxidizing agent such as nitrate ion.

Japanese Pat. No. 77,004,180 describes the use of triplet sensitizers for BLMB. Suitable sensitizers are aromatic carbonyl compounds and aromatic nitro compounds. Said patent describes both negative and positive systems, and is a counterpart to Japanese Pat. No. 77,025,330. The compositions described therein are UV light sensitive whereas the compositions of this invention are light sensitive through the entire wavelength range of 300–900 nm.

Japanese Pat. No. 76,035,847 describes photosensitive heat fixable recording materials containing a free radical producing organic halogen compound, leuco dye and a base. This is a negative acting system which contains no oxidizer.

Japanese Pat. No. 77,025,088 describes photosensitive compositions containing an acid sensitive leuco dye (e.g. naphthospiropyran), a photochemical acid generating agent which is a mixture of an organic halide (e.g., $CBr_4$), with a furan containing compound.

Japanese Pat. No. 79,001,453 describes a photothermographic material which contains an oxidizer, a compound with the oxidizer to change or develop color, and a compound which deactivates the color developer either in exposed or unexposed regions. Images can be either positive or negative. The light-sensitive materials used were colorless or nearly colorless aryl quinones and ultraviolet light sources were used. No other photosensitive materials appear to be taught.

Decolorizable imageable systems comprising a binder, nitrate salt, acid, and dyes are disclosed in U.S. Pat. Nos. 4,336,323 and 4,373,020. These systems are particularly useful as antihalation layers in photothermographic systems where the development temperature acts to bleach the dye.

The use of photobleachable dyes including o-nitroarylidene dyes as antihalation or acutance dyes is known in the art: U.S. Pat. Nos. 4,111,699; 4,271,263; 4,088,497; 4,033,948; 4,028,113; 3,988,156; 3,988,154; 3,984,248; 3,615,432 (RE28,225).

Japanese Pat. No. 88,058,108 teaches the use of salts of heptavalent and hexavalent molybdenum compounds and benzoyl leuco methylene blue in thermally imaged compositions. Also included are nitric acid salts of leuco methylene blue, but only when simultaneously in the form of a molybdenum complex or salt. Nitric acid, sulfuric acid, and hydrochloric acid are taught as forming useful salts with leuco methylene blue in the presence of molybdenum compounds, only nitrate salts are useful in the present invention.

Japanese Pat. No. 88,058,109 teaches the use of salts of heptavalent molybdenum compounds and benzoyl leuco methylene blue in thermally imaged compositions. Also required is an included compound containing both oxidizer and reducer moieties.

Japanese Pat. No. 88,058,110 describes the use of salts of hexavalent and heptavalent molybdenum compounds condensed to form ios- and hetero-polyacids in photothermally imaged compositions.

Japanese Pat. No. 88,058,111 discloses the use of salts of hexavalent and heptavalent molybdenum compounds in the presence of blocked phenols in thermally imaged compositions.

The latter four Japanese references apparently show that only blue to black images were successfully generated. This is expected since molybdic acid oxidation of organic compounds generally leads to dark blue-black color formation. This fact makes molybdenum based oxidizers unsuitable for applications in which other colors such as red or green are desired. Imaging systems free of molybdenum active ingredients are therefore desired.

SUMMARY OF THE INVENTION

This invention provides a photothermographic composition with improved speed and reduced moisture sensitivity and provides a photothermographic composition which is dispersed in a binder. The photothermographic composition can be dispersed in a binder, and coated on a substrate or coated onto a substrate without the aid of a binder. The present invention provides a photothermographic layer comprising a photobleachable sensitizer.

The present invention is achieved by providing leuco dye oxidizing acid salts and combining said salts with a sensitizing dye.

DETAILED DESCRIPTION INVENTION

Leuco Dye Oxidizing Acid Salts

Leuco dye oxidizing acid salts as defined herein consist of a salt or mixed salt of an oxidatively triggerable leuco dye and one or more oxidizing acids.

Oxidatively triggerable leuco dyes are well known. These are colorless compounds which when subjected to an oxidation reaction form colored dyes. These leuco dyes are well described in the art (e.g., U.S. Pat. No. 3,974,147, *The Theory of Photographic Process,* 3rd Ed.; Mees, C.E.K.; James, R., Eds.; MacMillan: New York, 1966, 283–284, 390–391; and Kosar, J. *Light-Sensitive Systems*; John Wiley and Sons: New York, 1965; pp. 367, 370–380, 406. Only those leuco dyes which can be converted to colored dyes by oxidation are useful in the practice of the present invention. Preferred leuco dyes include acylated leuco azine, phenoxazine, and phenothiazine dyes, examples of which are disclosed in U.S. Pat. Nos. 4,460,677, 4,647,525 and G.B. Pat. No. 1,271,289.

Oxidizing acids are well known in the art and include, but are not limited to nitric, nitrous, peroxonitric, hyponitrous, perchloric, periodic, peroxophosphoric, chromic, permanganic, oxalic, peroxosulfuric, and sulfurous acids as well as organic peracids such as monopermaleic acid. For the purposes of this invention the term "stable oxidizing acid" is defined as an oxidizing acid which: 1) must be derived from a Group V, VI or VII element, (Barrow, C. *General Chemistry*: Wadsworth, Belmont, Calif. 1972, p 162), and 2) forms a stable salt with the leuco dye at ambient temperature, and 3) the oxidizing acid must not react with dialkyl ether or cyclic ethers at 30° C. Preferably, the oxidizing acid is nitric or perchloric acid which generally satisfy the aforementioned conditions. More preferably the oxidizing acid is nitric acid.

Acid or base sensitive dyes such as phenolphthalein and other indicator dyes are not useful in the present invention. Further, only those leuco dyes which have basic functionality capable of forming an acid base salt with an oxidizing acid are useful in the practice of the present invention.

Acid or base sensitive dyes such as phenolphthalein and other indicator dyes are not useful in the present invention. Further, only those leuco dyes which have basic functionality capable of forming an acid base salt with an oxidizing acid are useful in the practice of the present invention. Accordingly, the leuco dye must contain at least one of a 1°, 2°, or 3° amine, and the anion must be derived from an oxidizing acid having a $pK_a$ less than or equal to about 0.

The imageable compositions of the present invention must be substantially anhydrous, that is they perform optimally in the absence of moisture. It is however acceptable to have moisture in small quantities, preferably less than about 2 percent by weight.

The leuco dye oxidizing acid salt should be present as at least about 0.1 percent and less than about 25 percent by weight of the total weight of the photothermographically sensitive composition. Preferably the oxidizing acid leuco dye salt should be present as 0.1 to 5.0 percent by weight of the dry weight of the imageable composition, and most preferably as 0.1 to 3.0 percent by weight of the dry weight of the imageable composition. In some cases the free base of the leuco dye employed may additionally be present. In such a case it is preferred that the free base be kept at a level less than 30 mole percent of the leuco dye oxidizing acid salt, and more preferably less than 5 mole percent.

It should be further noted that the compositions of the present invention are sensitive to temperatures as low as about 70° C. while compositions known in the art tend to be sensitive only in the range of 120° C. or higher.

Sensitizing Dyes

The term "sensitizing dye" used herein refers to a chemical substance which is photosensitive to light of wavelength between 300 and 900 nm, and subsequently spectrally sensitizes nitrate mediated leuco dye oxidation to give an image. Compounds useful as sensitizing dyes of this invention include, but are not limited to o-nitro-substituted arylidenes, aryl nitrones, cyanines, merocyanines, azines, oxazines, xanthenes, anthraquinones, indigoids, substituted diaryl- and triarylmethanes, diazos, indamines, acridines, methines and polymethines, thiazoles, thiazines, aminoketones, porphyrins, polycyclic aromatic hydrocarbons, p-substituted amino styryl compounds, and pyrylium dyes. The sensitizing dye is, of course, a different dye than the leuco dye or the oxidized color form of the leuco dye.

In a preferred embodiment the sensitizer dye is photobleachable. In such a case residual background stain is lessened or completely removed, resulting in improved image quality and color fidelity. Preferred photobleachable sensitizer dyes are o-nitro-substituted arylidene dyes. As employed herein the term "arylidene" refers to a group formed by an aryl group and a methine linkage (e.g., benzylidene, cinnamylidene, etc.) to another organic group. o-Nitro-substituted arylidene dyes contain an o-nitro-substituted aryl group joined through a methine chain linkage to a basic heterocyclic nucleus containing an electron-donating atom, typically a nitrogen, oxygen, or sulfur electron-donating atom. The number of atoms joining the electron donating atom and the aryl group may be even or odd number.

In a preferred embodiment, the o-nitro-substituted aryl group is joined through an acyclic methine chain containing an even or odd number of methine groups to a 5- or 6-membered basic, cyanine dye-type heterocyclic nucleus. The heterocyclic nucleus can have additional carbocyclic and heterocyclic rings fused thereto. The o-nitro-substituted aryl group can contain a phenyl or heterocyclic nucleus, or can contain a nucleus formed by fused aromatic or heteroaromatic rings, such as naphthyl and the like. U.S. Pat. Nos. 3,984,248, 3,988,154, 3,988,156, and 4,271,263 disclose certain members of the o-nitroarylidene dyes as acutance agents in thermally-developable photosensitive compositions. U.S. Pat. No. 4,095,981 discloses certain members of the o-nitroarylidene dyes as energy sensitive dyes in silver based photographic or photothermographic materials. In a specific preferred embodiment of this invention, the o-nitro-substituted dyes have one of the three general formulae.

Formula 1 is given by:

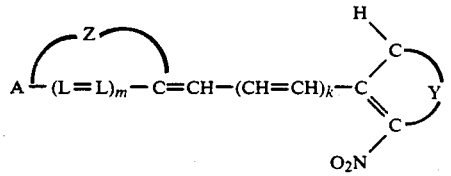

wherein k represents 0 or 1;

m represents 0 or 1;

each L represents a methine group, including substituted methine groups (e.g., —CH=, —C(CH3)=, etc.);

A represents an electron donating moiety, such as oxygen (—O—), sulfur (—S—), or

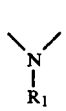

$R_1$ represents (1) an alkyl group having from 1 to 18 carbon atoms and preferably a lower alkyl group having from 1 to 4 carbon atoms (e.g., methyl, ethyl, propyl, isopropyl, butyl, sec-butyl, isobutyl, tert-butyl); a sulfoalkyl group, preferably sulfo lower alkyl containing from 1 to 4 carbon atoms in the alkyl moiety (e.g., β-sulfoethyl, γ-sulfopropyl, γ-sulfobutyl, etc.); a carboxyalkyl group, preferably a carboxy lower alkyl containing from 1 to 4 carbon atoms in the alkyl moiety (e.g., β-carboxyethyl, γ-carboxypropyl, δ-carboxybutyl, etc.); a sulfatoalkyl group, preferably a sulfato lower alkyl containing 1 to 4 carbon atoms in the alkyl moiety (e.g., β-sulfatoethyl, γ-sulfatopropyl, δ-sulfatobutyl, etc.); an alkoxyalkyl group, preferably a lower alkoxy lower alkyl containing from 1 to 4 carbon atoms in both the alkoxy and alkyl moieties (e.g., β-methoxyethyl, γ-methoxypropyl, δ-propoxybutyl, etc.); an acyloxyalkyl group preferably an acyloxy lower alkyl containing from 1 to 4 carbon atoms in the alkyl moiety (e.g., acetyloxyethyl, propanoyloxyethyl, butanoyloxybutyl, benzoyloxyethyl, toluyloxypropyl, etc.); an alkoxycarbonylalkyl group, preferably a lower alkoxy carbonyl lower alkyl containing from 1 to 4 carbon atoms in both the alkoxy and alkyl moieties (e.g., β-methoxycarbonylethyl, δ-ethoxycarbonylbutyl, β-butoxycarbonylethyl, etc.); a dialkylaminoalkylene group, preferably a di-lower alkylamino lower alkylene containing from 1 to 4 carbon atoms in the alkylene and the alkyl moieties (e.g., dimethylaminoethylene, diethylaminopropylene, diethylaminobutylene, etc.); a cycloaminoalkylene group, preferably cycloamino lower alkyl containing 4 to 6 atom in the cycloamino moiety and 1 to 4 atoms in the alkyl moiety (e.g., pyrrolidinylethylene, morpholinopropylene, piperidinebutylene, pyrrolidinylmethylene, etc.); (2) an alkenyl group (including a substituted alkenyl group), preferably a lower alkenyl containing 2 to 4 carbon atoms (e.g., ethyl, allyl, 1-propenyl, 1-butenyl, 2-butenyl, etc.); or (3) an aryl group (including a substituted aryl), such as phenyl, naphthyl, tolyl, xylyl, halophenyl (e.g., p-chlorophenyl, p-bromophenyl, etc.), alkoxyphenyl (such as methoxyphenyl, 2,4-dichlorophenyl, etc.), and an alkyl group, preferably an aryl lower alkyl containing from 1 to 4 carbon atoms in the alkyl moiety (e.g., benzyl, β-phenethyl, ω-phenbutyl, etc.); or (4) hydrogen; and Y represents the atoms necessary to complete an aryl (preferably phenyl or naphthyl) ring which is o-nitro-substituted and preferably is also p-substituted with a nitro or other electron withdrawing group and which aryl ring can have other substituents attached to it and other carbocyclic rings fused to it (e.g., 2-nitrophenyl, 2,4-dinitrophenyl, 2,6-dinitrophenyl, 2,4,6-trinitrophenyl, 2-nitronaphthyl, 2,4-dinitronaphthyl, 2-nitro-4-cyanophenyl, 2-nitro-4-ethoxycarbonylphenyl, 2-nitro-4-trifluoromethylphenyl, and the like); and Z represents the nonmetallic atoms necessary to complete a heterocyclic nucleus of the type used in cyanine dyes containing 5 or 6 atoms in the heterocyclic ring containing the electron-donating atom of the formula which ring can contain a second heteroatom such as oxygen, nitrogen, selenium, or sulfur. The heterocyclic nucleus preferably is selected from the group consisting of thiazole nucleus including substituted and unsubstituted benzothiazole and naphthothiazole nuclei and like (e.g., thiazole, 4-methylthiazole, 4-phenylthiazole, 4,5-diphenylthiazole, 4-(2-thienyl)thiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzophenylbenzothiazole, 5-methoxybenzothiazole, 5-ethoxybenzothiazole, 6-chlorobenzothiazole, 6-ethoxybenzothiazole, 5-methoxynaphtha[2,3-d]thiazole, 5-nitrobenzothiazole, 6-nitrobenzothiazole, 5-chloro-6-nitrobenzothiazole, etc.); an oxazole nucleus including substituted and unsubstituted benzoxazole and naphthoxazole nuclei and the like (e.g., oxazole, 4-phenyloxazole, benzoxazole, 5-chlorobenzoxazole, 5-methylbenzoxazole, 5-bromobenzoxazole, 5-methoxybenzoxazole, 5-ethoxybenzoxazole, 5-phenylbenzoxazole, 5-nitrobenzoxazole, 6-nitrobenzoxazole, 5-chloro-6-nitrobenzoxazole, etc.); a selenazole nucleus including substituted or unsubstituted benzoselenazole and naphtoselenazole nuclei and the like (e.g., selenazole, 4-methylselenazole, 4-nitroselenazole, 4-phenylselenazole, benzoselenazole, 5-chlorobenzoselenazole, 6-chlorobenzoselenazole, naphtho[2,1-l]selenazole, 5-nitrobenzoselenazole, 6-nitrobenzoselenazole, 5-chloro-6-nitrobenzoselenazole, nitro-group substituted naphthoselenazoles, etc.); a thiazoline nucleus (e.g., thiazoline, 4-methylthiazoline, 4-nitrothiazoline, etc.); a 2-pyridine nucleus, (e.g., 2-pyridine, 5-methyl-2-pyridine, etc.); a 4-pyridine nucleus (e.g., 4-pyridine, 3-methyl-4-pyridine, nitro-group substituted pyridines, etc.); a 3,3-dialkylindolenine nucleus (e.g., 3,3-dimethylindolenine, 3,3-diethyl-5- or 6-cyanoindolenine, 3,3-diethyl-5- or 6-nitroindolenine, 3,3-dimethyl-5- or 6-nitroindolenine, etc.); an imidazole nucleus (e.g., imidazole; 1-alkylimidazole; benzimidazole; 1,3-dialkyl, 1,3-diaryl, or 1-alkyl-3-arylimidazoles and benzimidazoles (e.g., 5-chloro-1,3-dialkylbenzimidazoles, 5-chloro-1,3-diarylbenzimidazoles, 5-methoxy-1,3-dialkylbenzimidazoles, 5-methoxy-1,3-diarylbenzimidazoles, 5-cyano-1,3-dialkylbenzimidazoles, 5-cyano-1,3-diarylbenzimidazoles, 1,3-dialkylnaphth[1,2-d]imidazole, 1,3-diarylnaphth[1,2-d]imidazole), etc.); a quinoline nucleus (e.g., quinoline, 6-methylquinoline, 6-methoxyquinoline, 6-ethoxyquinoline, 6-ethoxyquinoline, 6-chloroquinoline, 4-methoxyquinoline, 4-methylquinoline, 8-methoxyquinoline, 2-methylquinoline, 4-chloroquinoline, 6-nitroquinoline, etc.); an imidazo[4,5-b]quinoxaline nucleus (e.g., imidazo[4,5-b]quinoxaline, 1,3-dialkylimidazo[4,5-b]quinoxaline such a 1,3-diethylimidazo[4,5-b]quinoxaline, 6-chloro-1,3-diethylimidazo[4,5-b]quinoxaline, etc.; 1,3-dialkenylimidazo[4,5-b]quinoxaline such as 1,3-diallylimidazo[4,5-b]quinoxaline, 6-chloro-1,3-diallylimidazo[4,5-b]quinoxaline, etc.; 1,3-diarylimidazo[4,5-b]quinoxaline such as 1,3-diphenylimidazo[4,5-b]quinoxaline, 6-chloro-1,3-diphenylimidazo[4,5-b]quinoxaline, etc.); a 3H-pyrrolo[2,3-b]pyridine nucleus, (e.g., 3,3-dialkyl-3H-pyrrolo[2,3-b]pyridine such as 3,3-dimethyl-3H-pyrrolo[2,3-b]pyridine, 3,3-diethyl-3H-pyrrolo[2,3-b]pyridine, 1,3,3-trialkyl-3H-pyrrolo[2,3-b]pyridine such as 1,3,3-triethyl-3H-pyrrolo[2,3-b]pyridine, etc.); and a thiazolo[4,5-b]quinoline nucleus, a pyrylium (including benzopyrylium, thiapyrylium, and benzothiapyrylium) nucleus, and a dithiolinium nucleus.

Formula 2 is:

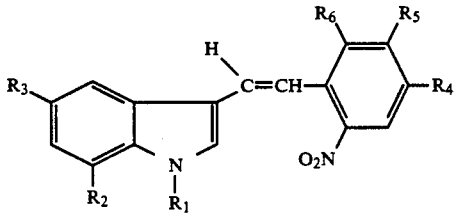

wherein

L and k are as previously defined; $R_1$ is as previously defined and preferably is hydrogen; $R_2$ and $R_3$ independently represent hydrogen, an alkyl or cycloalkyl group of 1 to 6 carbon atoms, an alkoxy or cycloalkoxy group of 1 to 6 carbon atoms, or halogen; $R_4$ represents hydrogen, nitro, cyano, a carboalkoxy group of 1 to 6 carbon atoms, or halogen; $R_5$ and $R_6$ are both hydrogen or together constitute a benzo group.

Formula 3 is:

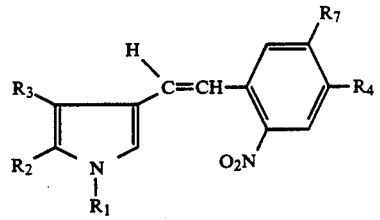

wherein $R_1$ through $R_4$ are as previously defined; $R_7$ represents hydrogen, an alkyl group of 1 to 6 carbon atoms, an alkoxy group of 1 to 6 carbon atoms, or halogen.

The sensitizing dye should be present as at least 0.05 percent by weight of the dried imageable composition, up to 1.5 percent by weight or more. Preferably, they are present at from 0.075 to 1.25 percent by weight of the composition and most preferably from 0.1 to 1.0 percent.

Initiator

Added initiators are also believed useful in the present invention. The term initiator refers to a free radical polymerization initiator. The following test may be used as a method of determining whether a compound qualifies as an initiator:

To 3 ml of a solution of 30 wt % pentaerythritol tetraacrylate in tetrahydrofuran is added 0.05 g 9,10-diethoxyanthracene and 0.2 g of the compound to be tested. The resultant solution is placed in a tube, deoxygenated by 3 freeze-pump-thaw cycles, and the tube is sealed (Tube A). A similar tube is also prepared as above, but omitting the compound to be tested (Tube B). A further tube is prepared as described for Tube A, but the 9,10-diethoxyanthracene is omitted (Tube C). Tubes A, B, an C are irradiated under identical conditions with light of wavelength between 350–400 nm. If Tube A gels in less time than Tubes B and C, then the compound being tested qualifies as an initiator.

Typical initiators include, but are not limited to diaryliodonium salts (e.g., diphenyliodonium hexafluorophosphate, ditolyliodonium hexafluoroantimonate, etc.), and halomethyl-s-triazines (e.g., tris(trichloromethyl)-s-triazine, bis(dichloromethyl)methyl-s-triazine, etc.) as well as other organic compounds having photolabile halogen atoms (cf U.S. Pat. 4,460,667).

Binder

Any natural or synthetic polymeric binder may be used in the practice of this invention. Organic polymeric resins, preferably thermoplastic resins (although thermoset resins may be used) are generally preferred.

Such resins as phenoxy resins, polyesters, polyvinyl resins, polycarbonates, polyamides, polyvinyl acetals, polyvinylidene chloride, polyacrylates, cellulose esters, copolymers and blends of these classes of resins, and others have been used with particular success. Where the proportions and activities of leuco dyes and nitrate ion require a particular developing time and temperature, the resin should be able to withstand those conditions. Generally, it is preferred that the polymer not decompose or lose its structural integrity at 200° F. (93° C.) for 30 seconds and most preferred that it not decompose or lose its structural integrity at 260° F. (127° C.). Preferred polymers include polyvinylidene chloride resins (e.g., Saran TM supplied by Dow Chemical, Midland, Mich.), phenoxy resins (e.g., PKHH TM and PAHJ TM supplied by Union Carbide, Hackensack, N.J.), and polyvinylformals (e.g., Formvar TM supplied by Monsanto Chemical, St. Louis, Mo.).

Beyond these minimal requirements, there is no criticality in the selection of a binder. In fact, even transparency and translucency are not required although they are desirable.

The binder serves a number of additionally important purposes in the constructions of the present invention. The imageable materials may be further protected from ambient conditions such as moisture. The consistency of the coating and its image quality are improved. The durability of the final image is also significantly improved. The binder should be present as at least about 25% by weight of ingredients in the composition, more preferably as 50% or 70% by weight and most preferably as at least about 80% by weight of dry ingredients (i.e., excluding solvents in the composition). A generally useful range is 30–98 percent by weight binder with 75 to 95 percent preferred.

Substrate

Suitable substrates on which the compositions of the present invention may be supported include but are not limited to metals (e.g., steel and aluminum plates, sheets, and foils); films or plates composed of various film-forming synthetic or high polymers including addition polymers (e.g., polyvinylidene chloride, polyvinyl chloride, polyvinyl acetate, polystyrene, polyisobutylene polymers and copolymers), and linear condensation polymers (e.g., polyethylene terephthalate, polyhexamethylene adipate, polyhexamethylene adipamide/adipate); nonwoven synthetic or wood (cellulosic) by-product based substrates such as paper and cardboard; and glass.

The imageable compositions of the present invention may contain various additional materials in combination with the essential ingredients of the present invention. For example, plasticizers, coating aids, antioxidants (e.g., ascorbic acid, hindered phenols, phenidone, etc.) in amounts that would prevent oxidation of dyes when heated; surfactants, antistatic agents, waxes, ultraviolet radiation absorbers, mild oxidizing agents in addition to the leuco dye oxidizing acid salt, and brighteners may be used without adversely affecting the practice of the invention.

EXAMPLES

The following dyes are employed in the examples below. Their structures and references to their preparation are included. All chemicals used are available from Aldrich Chemical (Milwaukee, Wis.), unless otherwise specified.

All materials employed in the following examples are available from Aldrich Chemical Company (Milwaukee, Wis.), unless otherwise specified.

Materials prepared in the examples below were tested or analyzed by at least one of the following techniques: $^1H$ nuclear magnetic resonance, infrared, ultraviolet, and mass spectroscopy; differential scanning calorimetry (DSC); and elemental analysis. All materials gave results consistent with the corresponding structures given herein. Pergascript Turquoise TM (PT), was obtained from Ciba-Geigy (Ardsley, N.Y.), Copikem II TM was obtained from Hilton-Davis (Cincinnati, Ohio).

Magenta LD was prepared according to EP Pat. No. 181,085. Purple LD was prepared according to U.S. Pat. No. 4,647,525. Cyan Dimer was prepared according to Japanese Pat. No. 75,020,809. Yellow LD1 was prepared according to the procedure of Bose, A. K.; Garrat, S. *J. Am. Chem. Soc.* 1962, 84, 1310. Yellow LD2 and Green LD were prepared according to U.S. Pat. No. 3,297,710.

The term $T_{exp}$ refers to the lowest temperature at which color development was observed in the exposed region, when thermally processed.

The term $T_{unexp}$ refers to the lowest temperature at which color development was observed in the unexposed region when thermally processed.

The term $D_{max}$ refers to maximum transmission optical density in the light exposed regions after thermal development.

The term $D_{min}$ refers to minimum transmission optical density in the non-light exposed region after thermal development. Densitometry measurements were made using a MacBeth Instrument Co. densitometer (Newburgh, N. Y.).

The term wt % refers to weight/weight percent.

Tetrahydrofuran is abbreviated THF.

EXAMPLES 1–7

The following examples teach the preparation of leuco dye oxidizing acid salts with the stoichiometry ((leuco dye)×n HX, wherein n is any positive real number), useful in the practice of this invention. One mmol, about 0.4 g, of leuco dye was dissolved in 60 ml anhydrous diethyl ether, and the resultant solution was optionally cooled to 0° C. A separate solution consisting of n mmol of the oxidizing acid to be used dissolved in 10 ml anhydrous diethyl ether was added to the cold leuco dye solution whereupon a salt immediately precipitated. The product was collected by suction filtration, washed with ether, and dried in vacuo. Generally, yields of 80–90% were obtained. For those dyes which were insoluble in diethyl ether an alternate procedure was used in which a minimum amount of tetrahydrofuran was used in place of the 60 ml diethyl ether (Note: addition of concentrated nitric acid to tetrahydrofuran may result in a fire).

TABLE 1

| Example | Acid | Leuco Dye | Decomposition Temperature (°C.) | Ratio (acid/dye) |
|---|---|---|---|---|
| 1 | $HNO_3$ | Pergascript TM Turquoise | 93 | 1:1 |
| 2 | " | Pergascript TM Turquoise | 91 and 180 | 2:1 |
| 3 | " | Magenta LD | 97 | 1:1 |
| 4 | " | Yellow LD1 | 140 | 1:1 |
| 5 | " | Yellow LD2 | 89 | 1:1 |
| 6 | " | Green LD | 187 | 1:1 |
| 7 | " | Copikem II TM | 99 | 2:1 |

EXAMPLES 8-10

In the following example 5 mg of the dinitroarylidene photobleachable dye (1), and 40 mg of the leuco dye mono-nitric acid salt was dissolved under subdued (and appropriately filtered) safelights in 7.5 g 20% PKHH in tetrahydrofuran (freshly distilled from benzophenone ketyl), knife coated at 4 mils wet thickness, air dried for 15 minutes, then oven dried for 5 minutes. Samples were evaluated by exposing half (lengthwise) of a strip of the film using a 3M Model 179 Contact Printer (intensity setting 32), for 20 seconds followed by thermal development on a Reichert Heizbank (Cambridge Instruments, Buffalo, N.Y.) thermal gradient bar. In these negative-acting systems, the onset temperatures of the light activated, thermally developed area, $T_{exp}$, and unexposed, $T_{unexp}$, define the imageability of the construction. The difference between them, $\Delta T$, defines the thermal process latitude. The photoactivated, thermally developed monochrome constructions of the three primary subtractive colors prepared include, Pergascript Turquoise TM, Magenta LD, and Yellow LD1.

TABLE 2

| Example | Leuco Dye | $T_{unexp}$ | $T_{exp}$ | $\Delta T$ | $D_{max}$ | $D_{min}$ |
|---|---|---|---|---|---|---|
| 8 | Pergascript ™ Turquoise × $HNO_3$ | 90 | 80 | 10 | 1.11 | 0.05 |
| 9 | Magenta LD × $HNO_3$ | 74 | 60 | 14 | 1.00 | 0.20 |
| 10 | Yellow LD1 × $HNO_3$ | 90 | 80 | 10 | 0.88 | 0.05 |

TABLE 2-continued

| Example | Leuco Dye | $T_{unexp}$ | $T_{exp}$ | $\Delta T$ | $D_{max}$ | $D_{min}$ |
|---|---|---|---|---|---|---|

EXAMPLES 11-17

This example further demonstrates the scope of leuco dye oxidizing acid salts useful in the present invention. Examples were prepared and analyzed as in Example 8 with modifications in formulation noted vide infra.

TABLE 3

| Example | Leuco Dye Acid Salt | Leuco wt % | Sensitizer wt % | $T_{exp}$ (°C.) | $T_{unexp}$ (°C.) | $D_{max}$ | $D_{min}$ |
|---|---|---|---|---|---|---|---|
| 11 | PT[a] × $HNO_3$ | 0.33 | 0.11 | 90 | 98 | 1.02 | 0.01 |
| 12 | " | 0.83 | 0.11 | 85 | 92 | 1.72 | 0.04 |
| 13 | " | 2.5 | 0.11 | 84 | 97 | 2.95 | 0.12 |
| 14 | Copikem ™ II × $HNO_3$ | 1.0 | 0.11 | 92 | 95 | 0.64 | 0.05 |
| 15 | Magenta LD × $HClO_4$ | 3.3 | 0.11 | 160 | 170 | 0.88 | 0.26 |
| 16 | Magenta LD × $HNO_3$ | 0.82 | 0.12 | 60 | 74 | 1.04 | 0.21 |
| 17 | Green LD × $HNO_3$ | 0.81 | 0.09 | 120 | 128 | 2.80 | 0.10 |

[a]PT = Pergascript ™ Turquoise

EXAMPLE 18

This example demonstrates that leuco dye oxidizing acid salts can be combined with leuco dye acid salts while maintaining effectiveness as an imageable composition in the present invention. The example was prepared and analyzed as in Example 8 with modifications in formulation noted vide infra.

TABLE 4

| Leuco Dye Acid Salt | Leuco wt % | Sensitizer wt % | $T_{exp}$ (°C.) | $T_{unexp}$ (°C.) | $D_{max}$ | $D_{min}$ |
|---|---|---|---|---|---|---|
| PT[a] × $HNO_3$/ PT[a] × $HBF_4$ | 0.33 0.33 | 0.12 | 88 | 92 | 1.78 | 0.04 |

EXAMPLES 19-20

These examples demonstrate that non-bleachable sensitizers may be used in the present invention. The examples were prepared and analyzed as in Example 8 with modifications in formulation noted herein.

TABLE 5

| Example | Leuco Dye Acid Salt | Leuco wt % | Sensitizer wt % | $T_{exp}$ (°C.) | $T_{unexp}$ (°C.) | $D_{max}$ | $D_{min}$ |
|---|---|---|---|---|---|---|---|
| 19 | Yellow LD2 × $HNO_3$ | 0.66 | 0.4[a] | 135 | 140 | 0.63 | 0.47 |

TABLE 5-continued

| Example | Leuco Dye Acid Salt | Leuco wt % | Sensitizer wt % | $T_{exp}$ (°C.) | $T_{unexp}$ (°C.) | $D_{max}$ | $D_{min}$ |
|---|---|---|---|---|---|---|---|
| 20 | PT × $HNO_3$ | 0.33 | 0.5[b] | 100 | 108 | 0.82 | 0.21 |

[a]Y1A used as sensitizer, 0.4 wt. % diphenyliodonium hexafluorophosphate added to binder solution.

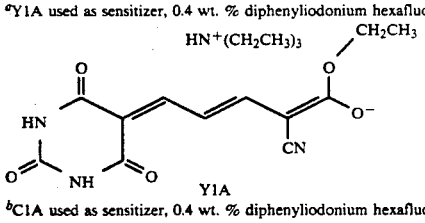

Y1A

[b]C1A used as sensitizer, 0.4 wt. % diphenyliodonium hexafluorophosphate added to binder solution.

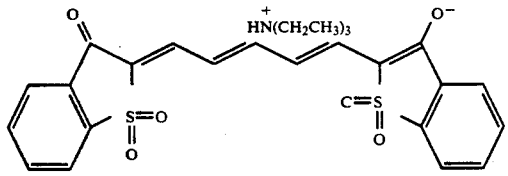

C1A

EXAMPLE 21

This example demonstrates that leuco dye oxidizing acid salts may be combined with leuco dyes in imageable compositions of this invention. The example was prepared and analyzed as in Example 8 with modifications in formulation as noted vide infra.

TABLE 6

| Leuco Dye Acid Salt | Leuco wt % | Sensitizer wt % | $T_{exp}$ (°C.) | $T_{unexp}$ (°C.) | $D_{max}$ | $D_{min}$ |
|---|---|---|---|---|---|---|
| PT × $HNO_3$ | 0.33 | 0.12 | 80 | 90 | 0.60 | 0.05 |
| Magenta LD | 0.33 | | | | | |
| PT × $HNO_3$ | 0.65 | 0.09[a] | 89 | 84 | 1.89 | 0.24 |
| PT | 0.35 | | | | | |

[a]Positive-acting sensitizer is:

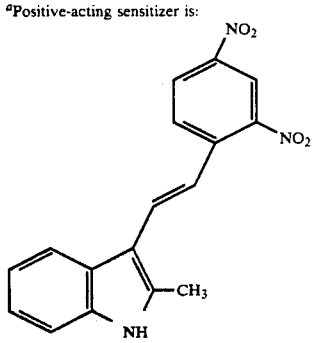

EXAMPLES 22–24

This example demonstrates the improved light sensitivity of the present invention. The following samples were prepared and coated as in Examples 8–10, except that the leuco dye acid salts were not employed, and an identical molar amount of leuco dye: lithium nitrate: succinic acid in the mole ratio of 1:1:0.5 was substituted for the leuco dye acid salt. Thus, Examples 22–24 are comparative tests of prior art compositions with Examples 8–10, respectively.

| Example | Leuco Dye | $T_{unexp}$ | $T_{exp}$ | T (°C.) | $D_{max}$ | $D_{min}$ |
|---|---|---|---|---|---|---|
| 22 | Pergascript ™ Turquoise | 140 | 135 | 5 | 1.03 | 0.3 |

-continued

| Example | Leuco Dye | $T_{unexp}$ | $T_{exp}$ | T (°C.) | $D_{max}$ | $D_{min}$ |
|---|---|---|---|---|---|---|
| 23 | Magenta | 140 | 138 | 2 | 0.22 | 0.10 |
| 24 | Yellow LD1 | >150 | >150 | NM | 0.06 | 0.06 |

NM = not measurable

Due to difficulties in maintaining even temperatures in processing equipment, a value of ΔT of ≧10° C. is a practical minimum for photothermographic imaging systems of the type practiced in the present invention. None of the above comparative examples achieve this standard which was achieved by each of Examples 8–10.

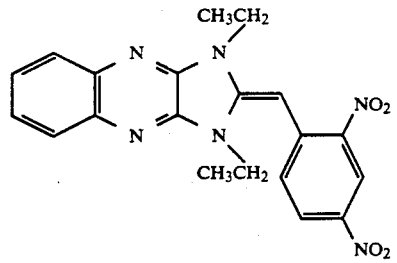

1

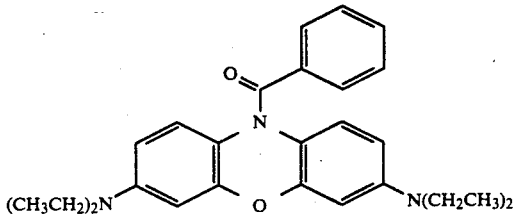

Pergascript Turquoise ™

-continued

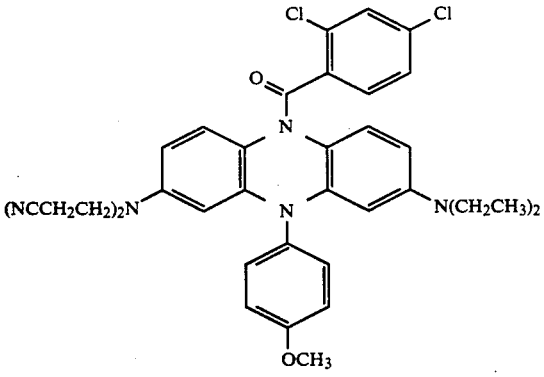

Magenta LD

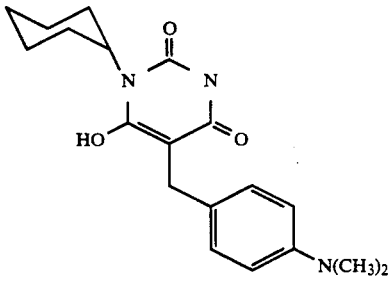

Yellow LD

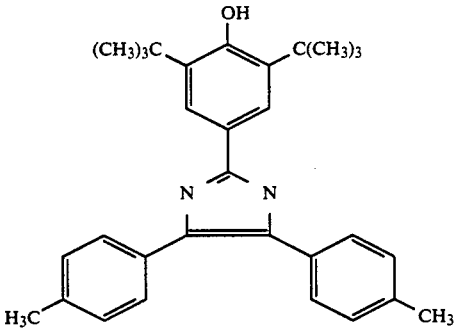

Yellow LD2

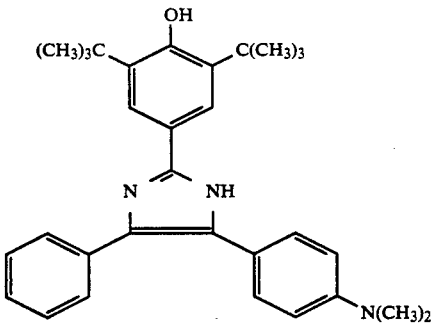

Green LD

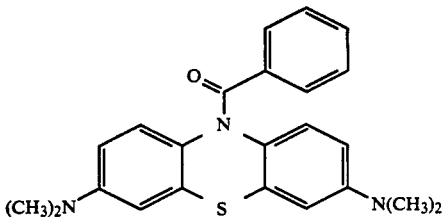

-continued

Copikem II TM

What is claimed is:

1. A photothermographic composition comprising a spectral sensitizing dye, and the salt formed from an oxidizing acid and a leuco dye, wherein said acid consists of a Group V, VI, or VII element, hydrogen, and oxygen, and said spectral sensitizing dye is a dye which is different from both said leuco dye and the oxidized color form of said leuco dye.

2. An imageable layer comprising a photothermographic composition according to claim 1.

3. An imaged layer comprising a photothermographic composition according to claim 2 having an imagewise distribution of dye therein formed by radiation of said leuco dye.

4. An imageable layer according to claim 2 wherein a binder is also present within said layer.

5. An imageable element comprising the layer according to claim 4 wherein said layer is coated on a substrate.

6. An imageable element according to claim 5 wherein said substrate is paper.

7. An imageable element comprising the layer according to claim 2 coated on a substrate.

8. An imageable element according to claim 7 wherein said substrate is paper.

9. An imageable layer according to claim 2 wherein said spectral sensitizing dye is a photobleachable dye.

10. An imageable layer according to claim 2 wherein said oxidizing acid, used to form a salt with the leuco dye, is nitric acid.

11. An imageable layer according to claim 2 wherein said leuco dye is a dialkylamino substituted leuco dye.

12. An imageable layer according to claim 2 wherein said leuco dye is a dialkylaminophenothiazine type leuco dye.

13. An imageable layer according to claim 2 wherein said leuco dye is a dialkylaminophenoxazine type leuco dye.

14. An imageable layer according to claim 2 wherein said leuco dye is a dialkylaminodiazine type leuco dye.

15. An imageable layer according to claim 2 wherein an initiator is also present.

16. An imageable layer according to claim 15 wherein said initiator is diphenyliodonium hexafluorophosphate.

17. An imageable layer according to claim 15 wherein said initiator is a tris(trichloromethyl)-s-triazine.

18. A photothermographic composition consisting essentially of a spectral sensitizing dye, and the salt formed from an oxidizing acid and a leuco dye, wherein said acid consists of a Group V, VI, or VII element, hydrogen, and oxygen, and said sensitizing dye is a dye which is different from both said leuco dye and the oxidized color form of said leuco dye.

19. The composition according to claim 18 wherein a binder is also present and wherein said spectral sensitizing dye is a photobleachable dye.

20. An imageable layer comprising a photothermographic composition comprising a photobleachable spectral sensitizing dye, and the salt formed from an oxidizing acid and a leuco dye, wherein said acid consists of a Group V, VI, or VII element, hydrogen, and oxygen, and said sensitizing dye is a dye which is different from both said leuco dye and the oxidized color form of said leuco dye, and wherein said photobleachable dye is an o-nitroarylidene dye of the formula:

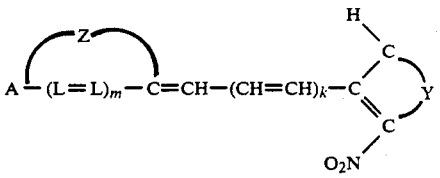

wherein k represents 0 or 1;

m represents 0 or 1; and each L represents a methine group, including substituted methine groups;

A represents an electron donating moiety, comprising oxygen (—O—), sulfur (—S—), or

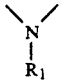

wherein $R_1$ is selected from an alkyl group having from 1 to 18 carbon atoms, a sulfoalkyl group having from 1 to 18 carbon atoms, a carboxyalkyl group having from 1 to 18 carbon atoms, a sulfatoalkyl group having from 1 to 18 carbon atoms, an alkoxyalkyl group having from 1 to 18 carbon atoms, an acyloxyalkyl group having from 1 to 18 carbon atoms, an alkoxycarbonylalkyl group having from 1 to 18 carbon atoms, a dialkylaminoalkylene group having from 1 to 18 carbon atoms, a cycloaminoalkylene group having from 1 to 18 carbon atoms, an alkenyl group having from 1 to 18 carbon atoms, an aryl group having from 1 to 18 carbon atoms, and hydrogen; and Y represents the atoms necessary to complete a phenyl or naphthyl ring; and Z represents the nonmetallic atoms necessary to complete a cyanine-type heterocyclic nucleus.

* * * * *

UNITED STATES PATENT AND TRADEMARK OFFICE

CERTIFICATE OF CORRECTION

PATENT NO. : 5,187,049

DATED : February 16, 1993

INVENTOR(S) : Sher et al.

It is certified that error appears in the above-indentified patent and that said Letters Patent is hereby corrected as shown below:

Col. 9, line 12, replace "mo" with --MO--

Col. 15, replace the second diagram with the following:

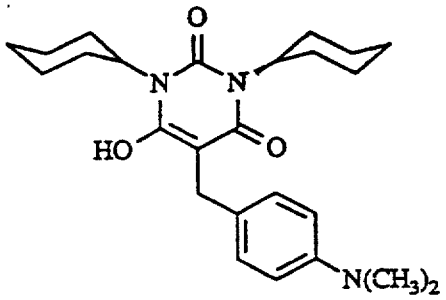

UNITED STATES PATENT AND TRADEMARK OFFICE

CERTIFICATE OF CORRECTION

PATENT NO. : 5,187,049

DATED : February 16, 1993

INVENTOR(S) : Sher et al.

It is certified that error appears in the above-indentified patent and that said Letters Patent is hereby corrected as shown below:

Col. 15, replace the third diagram with the following:

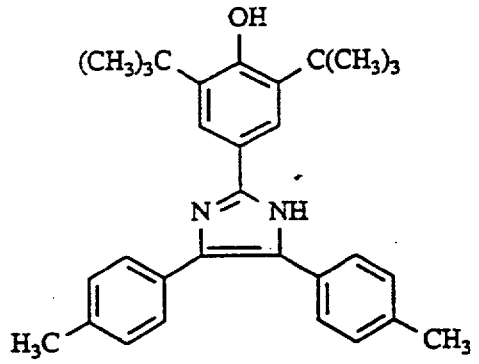

Signed and Sealed this

Thirteenth Day of September, 1994

*Attest:*

*Attesting Officer*

BRUCE LEHMAN

*Commissioner of Patents and Trademarks*